US005548851A

United States Patent [19]

Wien et al.

[11] Patent Number: 5,548,851

[45] Date of Patent: Aug. 27, 1996

[54] AQUATIC SAFETY SLIDE AND WADING POOL

[76] Inventors: Joshua D. Wien; Noah E. Wien, both of 11990 SW. 94th Ct., Miami, Fla. 33176

[21] Appl. No.: 310,910

[22] Filed: Sep. 22, 1994

[51] Int. Cl.[6] ..... E04H 4/00

[52] U.S. Cl. ..... 4/506

[58] Field of Search ..... 4/494, 496, 506, 4/513, 588; 472/117, 128, 134

[56] References Cited

U.S. PATENT DOCUMENTS

| | | | |
|---|---|---|---|
| 2,505,845 | 5/1950 | Alvarez | 4/588 |
| 2,616,096 | 11/1952 | Hasselquist | 4/506 |
| 2,982,547 | 5/1961 | Carrier . | |
| 4,547,919 | 10/1985 | Wang | 4/506 X |
| 4,762,316 | 3/1988 | Merino . | |
| 4,805,898 | 2/1989 | Jacober . | |
| 4,887,811 | 12/1989 | Tresh . | |
| 4,964,183 | 10/1990 | LaForce | 4/588 X |
| 5,233,705 | 8/1993 | Coleman et al. | 4/496 |
| 5,345,622 | 9/1994 | Plone | 4/588 |

*Primary Examiner*—Charles E. Phillips
*Attorney, Agent, or Firm*—Caesar Rivise Bernstein Cohen & Pokotilow, Ltd

[57] ABSTRACT

An aquatic safety slide and wading pool which provides increased comfort and cushioning through placement of the slide surface atop inflatable gas filled tubes. A ramp element is connected to the slide surface at the far end of the slide to slow down and brake the motion of the user and to prevent the user from sliding off the end of the slide onto rough ground. Also, longitudinally directed jets of water are injected at the beginning of the slide to provide a positive water flow from the beginning of the slide to the end of the slide to assist the user in the slide. The cushioning of the sides and bottom and the maximum shallow depth also provides safety for infants and tots when the apparatus is used as a wading pool.

18 Claims, 1 Drawing Sheet

AQUATIC SAFETY SLIDE AND WADING POOL

BACKGROUND OF THE INVENTION

This invention relates generally to an aquatic slide and wading pool and more particularly to an aquatic slide with safety features for preventing bruising or injury to users and providing more comfort in sliding than existing slides.

Various types of slides which are aquatic, i.e., which use water on the surface of the slide to reduce friction, are known. For example, U.S. Pat. No. 2,982,547 (Carrier) discloses an aquatic slide which uses a pipe which runs longitudinally along the slide and has a series of displaced openings. The slide uses foam rubber or plastic as a cushion against rough ground, stones or other objects.

U.S. Pat. No. 4,887,811 (Tresh) discloses a slide which is not aquatic but which uses a cushion comprising a pad made of PVC/nitrile foam.

An aquatic slide which is intended to simulate wave surfing is disclosed in U.S. Pat. No. 4,762,316 (Merino). The slide includes a longitudinal channel with openings which sprays water, a plurality of air inflated chambers, and a body board to give an undulating effect as the user slides down the length of the apparatus.

U.S. Pat. No. 4,805,898 (Jacober et al.) discloses a recreational slide assembly which fits onto an existing diagonally disposed slide. Water is injected at the top of the slide through openings which create a spray to lubricate the slide. The bottom of the slide exits into a splash or landing pad which extends into a water containing pool.

Existing aquatic slides do not have cushioning which properly protects the users in case of stones or rough ground from being bruised, and do not brake or slow down the user, i.e., prevent abrupt stops at the end of the slide, as does the present invention.

OBJECTS OF THE INVENTION

Accordingly, it is the general object of the instant invention to provide an aquatic safety slide which overcomes the shortcomings of present slides.

It is a further object of the instant invention to provide an aquatic safety slide with features which increase the comfort and safety of the users.

It is still a further object of the instant invention to provide an aquatic safety slide with improved cushioning to prevent bruises or injury to the user when the slide is placed on the ground.

It is still yet a further object of the instant invention to provide an aquatic safety slide with a means for braking and slowing down the user to prevent an abrupt stop and to prevent the user from sliding off the end of the slide, which may cause injury.

It is another object of the instant invention to provide an aquatic safety slide which is inflatable for use and which can be deflated, folded and compactly stored or transported.

It is still another object of the instant invention to provide an aquatic safety slide which is lubricated by a stream of water flowing in the longitudinal direction of the slide to facilitate sliding by the user.

It is still yet another object of the instant invention to provide an aquatic safety slide which can also serve as a wading pool for infants and small children.

SUMMARY OF THE INVENTION

These and other objects of the instant invention are achieved by providing an aquatic safety slide which is rectangularly shaped with inflatable sides and ends with a sliding surface disposed therein. Beneath the sliding surface is a series of parallel longitudinally extending hollow rolls which are also inflatable. A stream of water is injected at the front end of the slide under pressure which causes the water to flow positively in the longitudinal direction to the end of the slide.

Another important safety feature of the slide is a ramp element at the end of the slide which directs the user diagonally upward to slow down the user and apply a braking action to the user so that the user is not stopped abruptly and does not slide off the end of the slide into rough ground.

The apparatus may also be used as a wading pool for infants and small children. It is safe because it maintains a shallow depth of water, has smooth sides and shock-absorbent sides and bottom.

DESCRIPTION OF THE DRAWING

Other objects and many of the intended advantages of this invention will be readily appreciated when the same becomes better understood by reference to the following detailed description when considered in connection with the accompanying drawings wherein.

DETAILED DESCRIPTION OF THE PREFERRED EMBODIMENTS

Figure 1:
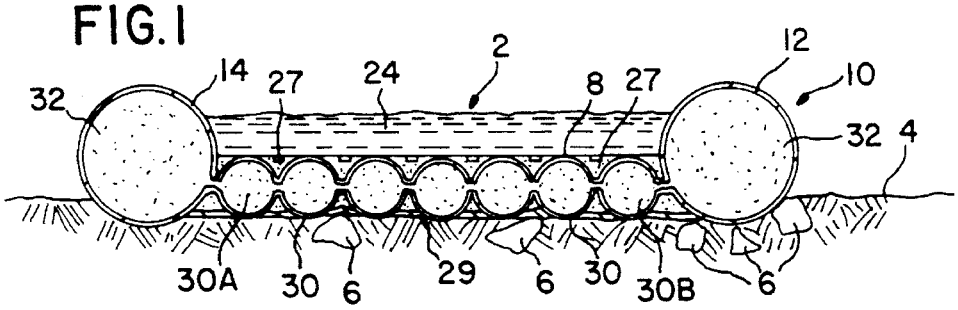
FIG. 1 is a lateral cross-sectional view of the aquatic safety slide taken along the line 1—1 of FIG. 2.
Figure 2:
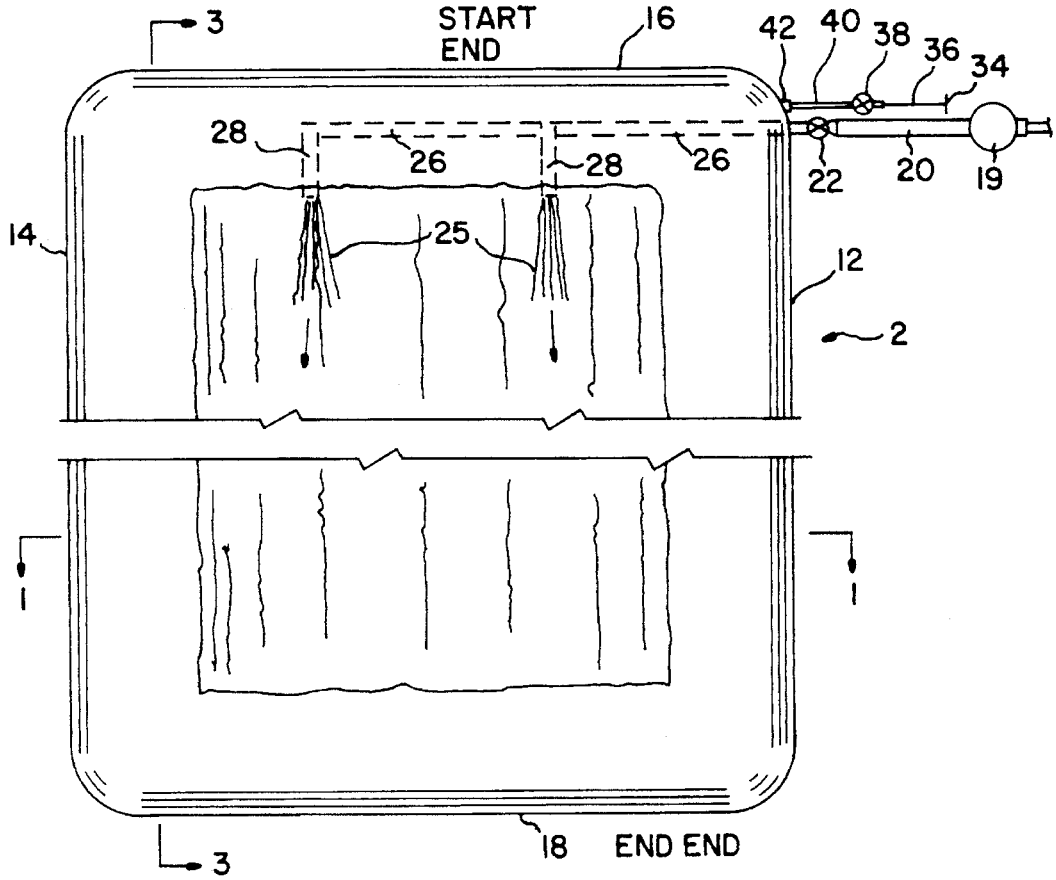
FIG. 2 is a foreshortened top plan view of the aquatic safety slide.
Figure 3:
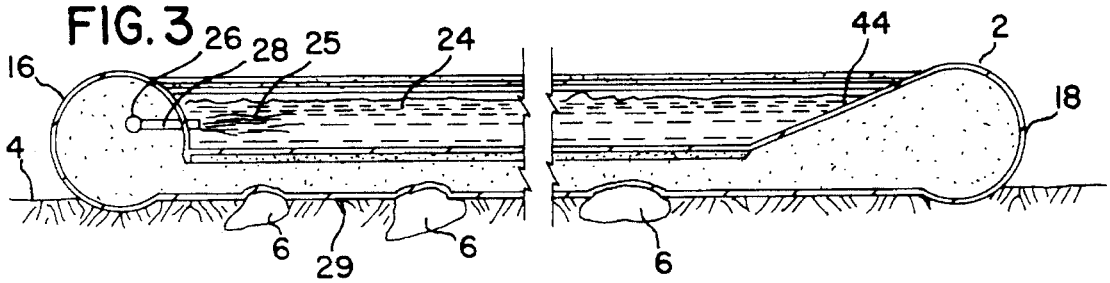
FIG. 3 is a longitudinal cross-sectional view of the safety slide taken along the line 3—3 of FIG. 2.

Referring now in greater detail to the various figures of the drawing, wherein like reference characters refer to like parts, there is shown in FIGS. 1, 2 and 3 the wading pool and aquatic safety slide 2 of the instant invention. The slide 2 is shown disposed on the ground 4, in which there are rough objects such as stones 6. The aquatic safety slide 2 is intended to be used in back yards or other play areas where the ground is often rough and sharp objects such as stones or other debris may be present.

The aquatic slide comprises an elongated rectangular frame 10 with opposing longitudinal cylindrically shaped parallel sides 12 and 14 and opposing cylindrically shaped parallel lateral ends 16 and 18. Disposed within the frame 10 is a slide surface 8 which is connected to the sides 12 and 14 and the ends 16 and 18. The frame 10 is inflatable so that it may be filled with gas to ready for use and may be deflated and folded when not in use to assume a compact form for transportation and storage as will be explained later.

As can be seen in FIG. 2, a source of water 19 is connected to one side of a pipe or hose 20. The other side of the pipe 20 is connected to the input to a valve 22. The output of the valve 22 is connected to a flexible hose 26. Flexible hose sections 28 are perpendicularly connected to the flexible hose 26. The water 24 is injected onto the slide surface 8 at the end 16 of the slide 2 in a pressurized stream 25 which imparts a flow to the water from the end 16 to the end 18 in the direction of the slide. This gives added impetus to the user when he slides from the start (end 16) on the slide surface 8 towards the end of the slide (end 18).

A series of inflatable tubes 30 is disposed beneath the slide surface 8. As shown in FIG. 1, the tubes 30 are in a parallel longitudinal array from end 16 to end 18. Passages between the tubes 30 and between the end tubes 30A and 30B and the sides 14 and 12, respectively, provide a gas communication means between the tubes 30, and the sides 12 and 14 and the ends 16 and 18.

FIG. 2 shows the connection of gas to inflate the tubes 30 and the frame 10. A gas source 34 is connected to one end of the pipe 36. The other end of pipe 36 is connected to the input of a valve 38. The output of the valve 38 is connected to one end of a pipe 40 while the other end of the pipe 40 is coupled to a connector 42 installed in the side 12 proximal the end 16. Thus, gas can be inserted into the frame 10 to inflate the sides 12 and 14 and the ends 16 and 18 and the tubes 30 when it is desired to use the slide.

A protective sheath 29 is connected to the bottom of the frame 10 to protect the tubes 30 from the rough earth and the sharp objects such as the stones 6 in the earth. It should also be noted that the upper interstices 27, the area between the upper hemisphere of the tubes 30 and the slide surface 8, tend to fill with water through openings at the connection between the slide surface 8 and the ends 16 and 18 (not shown). Thus, a multiple cushioning effect is obtained in that the user is provided the cushioning effect of the water 24 above the slide surface 8, the water 24 in the interstices 27 between the tubes 30, and the gas inflated tubes 30. This adds considerably to the comfort of the user and prevents bruises and injuries to the user when the slide 2 is placed on rough ground.

Another important feature of the aquatic safety slide 2 is shown in FIG. 3. The slide surface 8 is connected to a ramp element 44 which in turn connects to the side 18. Thus, when the user approaches the end 18 of the slide, the upward direction of the ramp 44 provides braking and slows the user down. This prevents the user from being brought to an abrupt stop at the end of the slide from sliding off the end of the slide onto the rough ground which is another potential source of injury.

The gas source may be an ordinary air pump and the water source may be a flexible hose with a hose connection to the frame 10. The flexible hoses 26 and 28 enable the slide 2 to be folded compactly after deflation for storage or transportation.

An aquatic safety slide has been described which increases the comfort and safety of the user through enhanced cushioning and by braking the slide of the user at the end of the slide. Additionally, the projection of the lubricating fluid, the water 24, in a pressurized stream 25 in the direction of the slide eases the slide and increases the speed of the slide for the user. It can also serve as a safe wading pool for infants and small children because of its shallow maximum depth and the cushioning of its sides and bottom.

Without further elaboration, the foregoing will so fully illustrate our invention, that others may, by applying current or future knowledge, readily adapt the same for use under the various conditions of service.

We claim:

1. An aquatic safety slide and wading pool comprising:

(a) an elongated rectangular frame comprising a first and a second side and a first and a second end, said ends and sides being inflatable and being cylindrical in shape; inflatable cylindrical tubes located in a side by side array between said ends and sides;

(b) means for inflating said inflatable ends, sides and tubes comprising a source of gas;

(c) a slide surface positioned on said tubes, spaces located between said slide surface and portions of adjacent tubes;

(d) said inflatable tubes comprising means for cushioning said slide surface; and (e) means for lubricating said slide surface comprising means for applying water to said slide surface and said water filling said spaces to provide an additional cushioning effect.

2. The slide and wading pool of claim 1 wherein said means for applying water to said surface comprises a first pipe having a first end connected to a water source, a valve connected to a second end of said first pipe, a second pipe having a first end connected to said valve and projecting through said first side and at least one third pipe perpendicularly connected to said second pipe.

3. The slide of claim 2 wherein said means for inflating said ends, sides and tubes comprises a fourth pipe having a first end connected to said source of gas, a valve having an input connected to a second end of said fourth pipe, and an output connected to a connector means which is installed in said first side.

4. The slide and wading pool of claim 1 wherein said plurality of tubes are connected to each other in a horizontal array parallel to each other and to said first and second sides, each of said tubes being connected to adjoining tubes with an opening at each side of each of said tubes and the first and last tubes of said array being connected to said first and second sides respectively with an opening between said first and last tubes and said respective first and second sides, said openings providing a gas communication channel from said inflating means to said sides, ends and said plurality of tubes.

5. The slide and wading pool of claim 4 wherein said gas is air and said source of gas comprises an air pump.

6. The slide and wading pool of claim 1 wherein said slide further comprises means for gradually slowing the slide of said person to a stop prior to said person's reaching the second end of said frame.

7. The slide and wading pool of claim 6 wherein said means for gradually slowing the slide of said person comprises a ramp element connected between said slide element and said second end.

8. The slide and wading pool of claim 7 wherein said means for applying water to said surface comprises a first pipe having a first end connected to a water source, a valve connected to a second end of said first pipe, a second pipe having a first end connected to said valve and projecting through said first side and at least one third pipe perpendicularly connected to said second pipe.

9. The slide and wading pool of claim 8 wherein said means for inflating said ends, sides and tubes comprises a fourth pipe having a first end connected to a gas source, a valve having an input connected to a second end of a fourth pipe, and an output connected to a connector means which is installed in said first side.

10. The slide and wading pool of claim 9 wherein said gas is air and said source of gas comprises an air pump.

11. The slide and wading pool of claim 1 wherein said slide further comprises means for gradually slowing the slide of said person to a stop prior to said person's reaching the second end of said frame.

12. The slide and wading pool of claim 11 wherein said means for gradually slowing the slide of said person comprises a ramp element connected between said slide element and said second end.

13. An aquatic safety slide for permitting a person to slide, comprising:

(a) an elongated rectangular frame comprising a first and a second side, a first and a second end, said ends and sides being inflatable and being cylindrical in shape;

(b) a sliding element disposed within said frame and having a sliding surface and a bottom surface;

(c) means for lubricating said surface;

(d) means for cushioning said sliding element;

(e) means for gradually slowing the slide of said person to a stop prior to said person's reaching said second end of said frame.

14. The slide and wading pool of claim 13 wherein said means for gradually slowing the slide of said person comprises a ramp element connected between said slide element and said second end.

15. The slide and wading pool of claim 14 wherein said means for lubricating said sliding surface comprises means for applying water to said sliding surface.

16. The slide and wading pool of claim 15 wherein said means for cushioning said sliding element comprises a plurality of inflatable tubes disposed beneath, and in contact with, said bottom surface, and a means for inflating said sides, ends and tubes.

17. The slide and wading pool of claim 13 wherein said slide is disposed upon rough ground and said slide further comprises a protective sheath disposed beneath said tubes and connected to said first and second sides and said first and second ends of said frame.

18. The slide and wading pool of claim 17 wherein said means for applying water to said surface comprises means to apply said water in a pressurized stream causing said water to flow from said first end to said second end of said slide.

* * * * *